299-13 SR
1/3/84 XR 4,423,907

United States Patent [19]
Ridley

[11] 4,423,907
[45] Jan. 3, 1984

[54] IN SITU RECOVERY OF SHALE OIL

[75] Inventor: Richard D. Ridley, Bakersfield, Calif.

[73] Assignee: Occidental Oil Shale, Inc., Grand Junction, Colo.

[21] Appl. No.: 834,464

[22] Filed: Sep. 19, 1977

Related U.S. Application Data

[63] Continuation-in-part of Ser. No. 563,607, Mar. 31, 1975, abandoned.

[51] Int. Cl.[3] ..... E21C 41/10
[52] U.S. Cl. ..... 299/2; 299/13; 299/19; 299/11
[58] Field of Search ..... 299/2, 13, 19, 11; 166/259; 102/23

[56] References Cited

U.S. PATENT DOCUMENTS 3,586,377 6/1971 Ellington ..... 166/259
3,661,423 5/1972 Garret ..... 299/2
3,917,346 11/1975 Janssen ..... 299/2

OTHER PUBLICATIONS

J. F. T. Agapito, Pillar Design in Competent Bedded Formation, Thesis for colorado School of Mines, 1972.
Sellers, et al., Rock Mechanics Research on Oil Shale Mining, paper delivered at AIME convention 1971.
Mining Engineer's Handbk., 3rd Ed., Peele ed., John Wiley & Sons N.Y., vol.1 pp. 477–478.

*Primary Examiner*—William F. Pate, III
*Attorney, Agent, or Firm*—Christie, Parker & Hale

[57] ABSTRACT

An in situ oil shale retort is formed in a subterranean formation containing oil shale and having horizontal cleavage planes extending parallel to the bedding of the formation and approximately orthogonal vertical cleavage plane sets extending perpendicular to the horizontal cleavage planes. The in situ retort is formed by excavating an opening or void in a retort site in the formation and placing explosive in the formation adjacent the void such that the explosive can fracture formation along the vertical cleavage planes and expand remaining formation within the retort site toward the void, forming a fragmented permeable mass of formation particles containing oil shale within the retort site.

20 Claims, 11 Drawing Figures

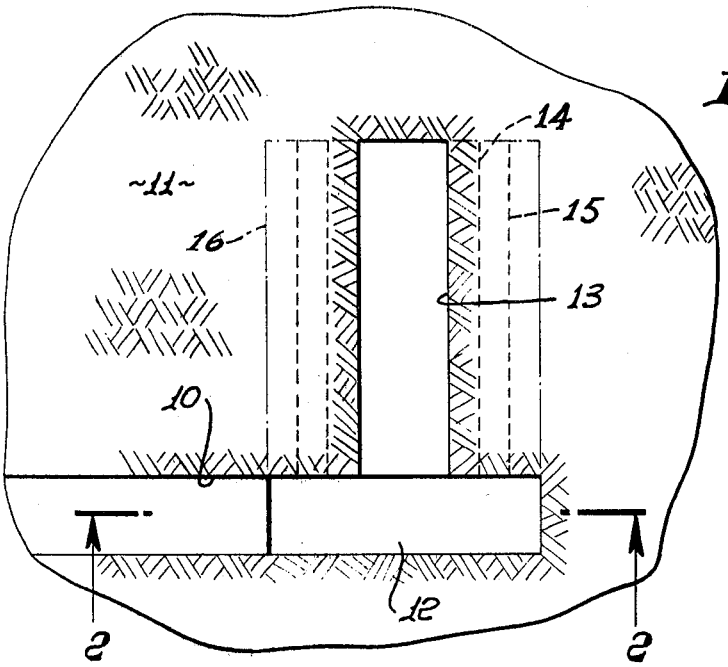
FIG. 1.
FIG. 2.
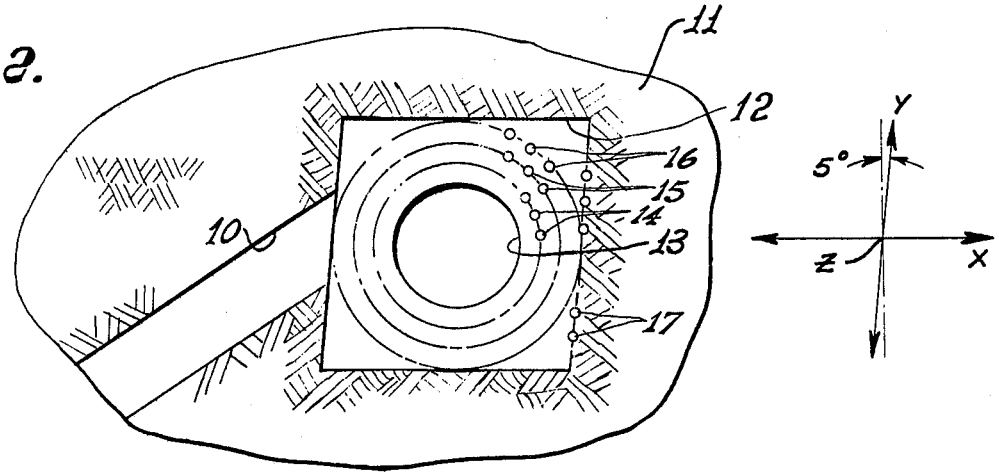
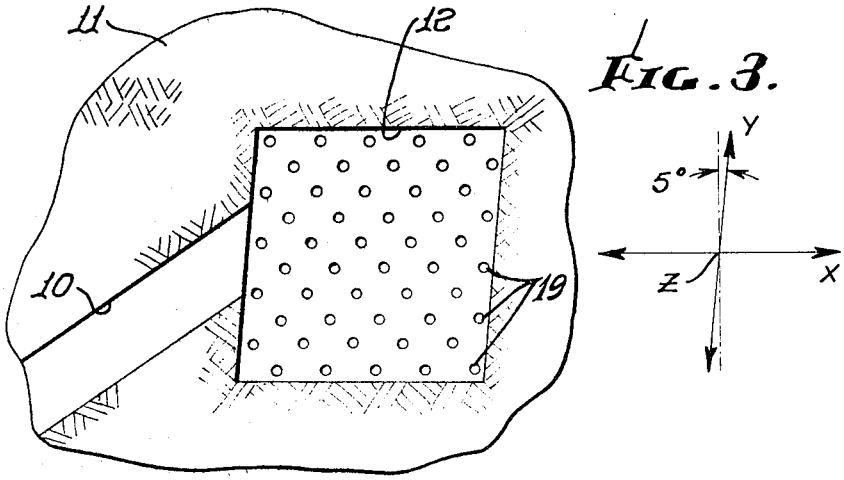
FIG. 3.

N
30

40
36
38
34
LEFT SLOT
PILLAR
RIGHT SLOT

⊙ JOINTS OVER 10 FEET LOCATED IN FRACTURE SET
△ OTHER FRACTURES OVER 10 FEET

IN SITU RECOVERY OF SHALE OIL

CROSS REFERENCE TO RELATED APPLICATION

This application is a continuation-in-part of application Ser. No. 563,607, filed Mar. 31, 1975 now abandoned. That application is incorporated herein by this reference.

BACKGROUND OF THE INVENTION

This invention relates to the in situ recovery of shale oil and, more particularly, to techniques for facilitating the formation and improving the operation of an in situ oil shale retort.

The term "oil shale" as used in the industry is in fact a misnomer; it is neither shale, nor does it contain oil. It is a sedimentary formation comprising marlstone deposit with layers containing an organic polymer called "kerogen" which upon heating dedcomposes to produce hydrocarbon liquid and gaseous products. The formation containing kerogen is called "oil shale" herein, and the hydrocarbon liquid product is called "shale oil".

One method for recovering shale oil is to form an in situ retort in a subterranean formation containing oil shale. Oil shale formation within an in situ retort site is fragmented to form a retort containing a fragmented permeable mass of formation particles containing oil shale. The formation particles at the top of the fragmented mass are ignited to form a combustion zone, and an oxygen-supplying gas, such as air, is supplied to the top of the fragmented mass to sustain the combustion zone and to advance the combustion zone downwardly through the fragmented mass. As the combustion zone advances through the fragmented mass, heated retorting gas forms a retorting zone on the the advancing side of the combustion zone where kerogen in the formation particles is decomposed to produce shale oil and product gases. Thus, a retorting zone moves from top to bottom of the fragmented mass in advance of the combustion zone. The shale oil and product gases produced in the retorting zone pass to the bottom of the fragmented mass for collection.

It is desirable that the gas flow through the fragmented mass be as uniform as possible. If the gas flow is uneven, i.e., more gas flows downward through certain paths than through other paths, the combustion zone can become skewed. With a skewed combustion zone, shale oil and product gases produced in the lagging region of the retorting zone may be decomposed in the leading region of the combustion zone, thereby reducing the yield of products from the fragmented mass. Relatively uniform fragmenting of formation particles is desirable with minimum mining and blasting costs.

An advantageous technique for fragmenting formation within an in situ oil shale retort site is to remove formation to form a void having a floor plan corresponding substantially to the horizontal cross section of the retort situ. Formation is excavated to form a vertical raise extending from the void for a distance corresponding to the height of the in situ retort being formed. Blasting holes are drilled from the void in concentric rings around the raise. After loading the blasting holes with explosive, the explosive in such blasting holes is detonated in sequence progressing outwardly from the raise. This and other techniques for fragmenting formation containing oil shale require a substantial amount of mining work, e.g., to form the void, the raise, and the blasting holes; and use a great deal of explosive, e.g., the explosive to load the blasting holes and the explosive to free formation removed in forming the void and the raise.

SUMMARY OF THE INVENTION

This invention concerns formation of an in situ oil shale retort in a subterranean formation containing oil shale and having approximately orthogonal vertical cleavage planes along which the formation preferentially fractures. According to one aspect of the invention, there is formed an in situ oil shale retort comprising a fragmented permeable mass of formation particles containing oil shale bounded by unfragmented formation having side walls aligned with substantially vertical cleavage planes in the subterranean formation.

According to another aspect of the invention, formation is excavated to form least one void, and explosive is placed in the formation so that detonating the explosive can preferentially fracture the formation along substantially vertical cleavage planes and expand fragmented formation particles toward such a void. For example, a void is first formed, and substantially vertical blasting holes are drilled from the void a distance corresponding to the height of the in situ retort being formed. The outer perimeter of blasting holes is arranged in a quadrangular series aligned with the cleavage planes. This principle can be extended to all the blasting holes, i.e., all the blasting holes are arranged in a number of rows aligned with the cleavage planes. Consequently, substantially less explosive is required to fragment formation within the retort site because it is broken along the cleavage planes.

According to another aspect of the invention, a void formed in the retort site has a quadrangular horizontal cross section with sides aligned with the cleavage planes. Consequently, the quantity of explosive and the mining work required to remove formation particles to form the void are substantially reduced.

In another embodiment, a vertically extending slot is excavated in the retort site so that remaining formation in the retort site has vertically extending free faces adjacent the slot. The vertical free faces are aligned with the vertical cleavage planes. Such remaining formation is explosively expanded toward the slot to form a fragmented permeable mass of formation particles containing oil shale in the in situ retort.

Techniques for forming an in situ oil shale retort wherein a void is excavated to form a vertically extending free face are described and illustrated in U.S. Pat. Nos. 4,043,595 and 4,043,596 each of which is assigned to the assignee of this application. These patents are incorporated herein by this reference.

An in situ oil shale retort also can be formed by excavating a void to leave a horizontally extending free face on adjacent formation. Such adjacent formation is then explosively expanded toward such a free face. Thus, for example, a retort can be formed by excavating a plurality of vertically spaced apart voids with a zone of unfragmented formation between adjacent vertically spaced apart voids. Such an unfragmented zone has a free face adjoining each of the adjacent vertically spaced apart voids. Explosive is placed in such an unfragmented zone in alignment with the vertical cleavage planes and then detonated. This causes explosive expansion of the unfragmented permeable mass of particles in an in situ oil shale retort. Such a zone of unfragmented formation can be expanded toward both free faces at the same time, or is stages toward one free face and then the other. A plurality of such zones of unfragmented formation can be explosively expanded toward adjacent voids in a single round.

Techniques for forming an in situ oil shale retort by excavating horizontally extending voids and explosive expansion of unfragmented formation toward such voids are described in U.S. Pat. Nos. 4,043,597 and 4,043,598, each of which is assigned to the assignee of this application. These patents are incorporated herein by this reference.

BRIEF DESCRIPTION OF THE DRAWINGS

Features of specific embodiments of the invention are illustrated in the drawings, in which:

FIG. 1 is a cross-sectional side view showing a portion of a subterranean formation containing oil shale during preparation of an in situ oil shale retort;

FIG. 2 is a horizontal cross-sectional view taken on line 2—2 of FIG. 1;

FIG. 3 is a cross-sectional bottom view similar to FIG. 2 and illustrating an alternative technique forming an in situ oil shale retort;

DETAILED DESCRIPTION

Figure 4:
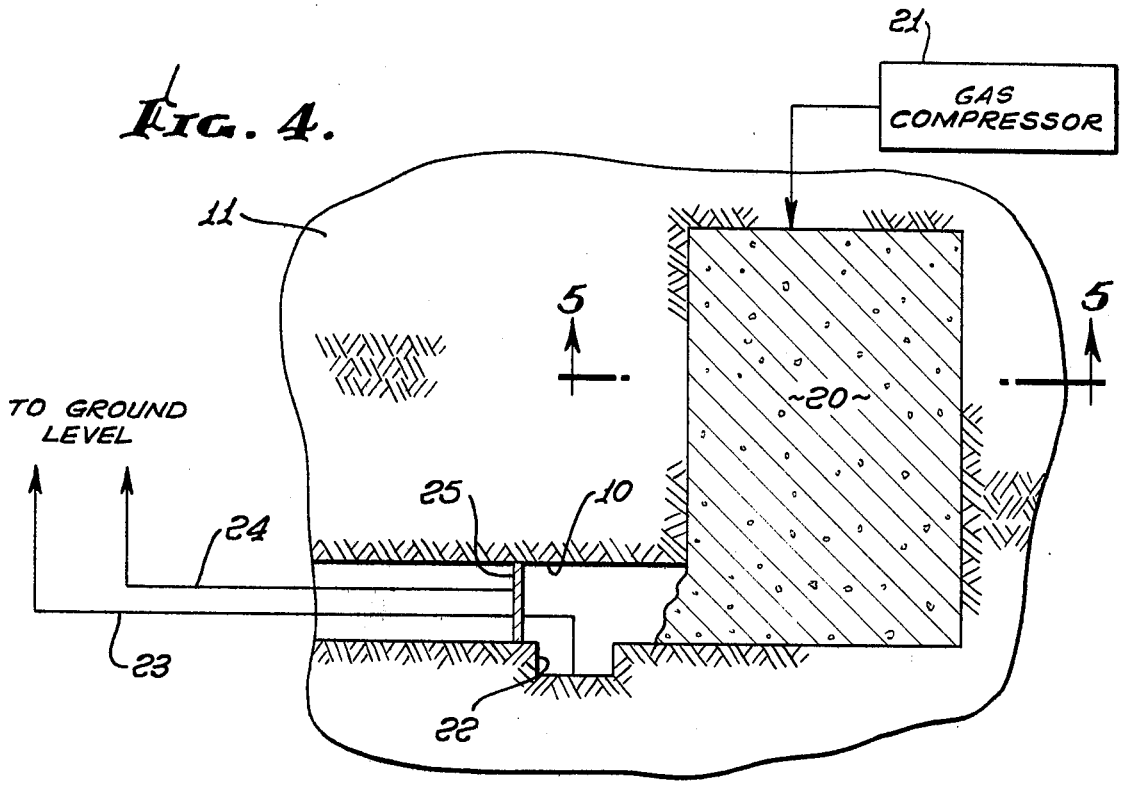
FIG. 4 is a cross-sectional side view showing the portion of the formation shown in FIG. 1 after completion of the in situ oil shale retort.

FIGS. 1 and 2 show a tunnel or drift 10 formed in a subterranean formation 11 containing oil shale. Formation which is excavated to form the drift 10 is transported to above ground through an adit or shaft (not shown).

A number of formations containing oil shale have horizontal cleavage planes extending substantially parallel to the lower boundary of the formation and vertical cleavage planes extending substantially perpendicular to the lower boundary of the formation. The vertical cleavage planes can extend through the formation at about right angles to one another. Designating a horizontal X-axis and a horizontal Y-axis extending through the formation parallel to the lower boundary of the formation, and an approximately vertical Z-axis extending through the formation perpendicular to the lower boundary of the formation, as shown in FIG. 2, the cleavage planes are parallel to planes passing through the formation and intersecting the X-Z, Y-Z, and X-Y axes, respectively. The X and Y, the X and Z, and the Y and Z axes are approximately orthogonal to each other.

"Cleavage plane" is defined in *A Dictionary of Mining, Mineral and Related Terms,* U.S. Dept. of Interior, 1968, as "any uniform joint, crack, or change in quality of formation along which rock will break easily when dug or blasted".

Formation containing oil shale breaks mush easier along the cleavage planes than along other planes extending through such a formation. As the formation is excavated to form the drift 10, formation at the side walls of the drift tends to break along the cleavage planes. The orientation of the cleavage planes extending through the formation parallel to the X-Z, X-Y, and Y-Z planes can be determined by measuring the surface angles of a number of protrusions from the side walls of the drift 10 and taking the average of the measured values, or conducting a statistical analysis of such measured values. Surface mapping of outcroppings can also be used to determine the orientation of principal directions of the cleavage planes. Another technique is analysis of core samples from the formation. By way of example, it is assumed that the Y-axis forms an angle of about 5 with a line extending through the formation perpendicular to the X-axis. An angle of about 3 degrees to 5 degrees is often found in formations containing oil shale so that the planes are approximately rather than precisely orthogonal.

It is also found that there is some angular dispersion of the cleavage planes within a set of cleavage planes. That is, when orientations of fractures of the underground formation are determined they are not found to be precisely parallel with each other. The fractures have a deviation in strike which can be a few degrees each side of a mean value of the strike. The orientation of the cleavage planes is considered to be the mean value of strike of the fractures. Some dispersion also can be found in the dip of the cleavage planes; although the mean value is substantially vertical, some individual cleavage planes may deviate a few degrees from vertical.

A portion of the formation is excavated from the underground formation 11 to form a quadrangular room or void 12 having a perimeter corresponding to the horizontal cross section of the in situ retort being formed, and having sides extending through the formation parallel to cleavage planes extending through the formation parallel to the Y-Z and X-Z planes, as illustrated in FIG. 2. Such alignment facilitates the mining work and reduces the quantity of explosive required to fragment formation excavated to form the void 12. The floor plan of the void 12 corresponds to the horizontal cross section of an in situ oil shale retort being formed in the formation 11.

A raise 13 comprising a hollow region or columnar void having a circular cross section extends vertically upward from the center of the void 12 for a distance corresponding to the height of the in situ retort being formed. For a description of a technique for forming the raise 13, reference is made to aforementioned U.S. Pat. No. 4,043,595. That patent discloses that the void volume of the fragmented formation particles in an in situ retort being formed is controlled by the ratio of the cross-sectional are of the raise 13 to the horizontal cross-sectional area of the in situ retort being formed.

One way of forming the raise 13 is to blast it out to its full cross section in a series of vertical increments moving toward the top of the formation 11. In order to permit the fragmented formation particles resulting from such a blast to flow freely into the void 12 for removal, the height of each blasted increment is preferably less than 0.95 of the smallest cross-sectional dimension of the raise 13, i.e., the length of the shortest side. To remove each increment, a plurality of vertically extending blasting holes are loaded with explosive, and the explosive is detonated to fragment and remove formation from the raise. The resulting fragmented formation particles containing oil shale are removed from the void 12 through the drift 10. The described enlargement step is repeated until the desired height of the raise 13 is attained.

Another way of forming the raise 13 is to blast it out in its full length in a series of incremental layers moving outwardly from a central bore hole. An initial vertical raise of relatively small cross section is formed, extending from the middle of the void 12 upwardly for the full length of the final raise, by drilling, boring, etc. This initial raise is enlarged by drilling a closed band or series of vertical blasting holes in a ring or circle concentric with the initial raise and of about the same length. The blasting holes are loaded with explosive, the explosive is detonated, and the resulting fragmented mass of formation particles is removed from the void 12 through the drift 10. The cross-sectional area of the original raise is preferably greater than about 18% of the cross-sectional area of the closed ring of blasting holes. If the cross-sectional area of the original raise is less than about 18% of the cross-sectional area of the ring of blasting holes, the fragmented mass of formation particles produced around the raise might freeze in place, i.e., might not flow freely down into the void 12. The described enlargement step is repeated one or more times to increase the cross section of the raise to the final desired cross section for the raise 13 in increments that will permit free flow of resulting fragmented formation particles down into the void 12 in each increment.

After the formation of the raise 13, a number of successively larger coaxial rings of vertical blasting holes 14, 15 and 16 are drilled from the void 12 upwardly the full length of the raise 13. An outer band of blasting holes 17 defines the vertical sides of the in situ retort to be formed. The outer band of blasting holes 17 is aligned with the vertical cleavage planes extending through the formation substantially parallel to the X-Z and Y-Z planes. This arrangement of blasting holes defines the vertical sides of the retort being formed. The vertical sides are parallel to the vertical cleavage planes, which assures reasonably smooth walls in the retort being formed, as well as minimizing the quantity of explosive required fragmenting formation in the retort site.

According to another technique for forming an in situ oil shale retort, a vertically extending columnar void in the shape of a narrow, elongated slot is excavated in the retort site. The surface of the formation defining such a slot-shaped columnar void provides a pair of parallel free faces extending vertically through the oil shale formation. A portion of the formation adjacent the free faces is explosively expanded toward such a columnar void to form a fragmented permeable mass of particles in the retort. Such a technique is described in the aforementioned U.S. Pat. Nos. 4,043,595 and 4,043,596.

Explosive is placed in formation adjacent such a slot-shaped columnar void by forming a plurality of vertically extending blasting holes in the second portion extending parallel to the free faces and loading explosive into the blasting holes. Such blasting holes are arranged in rows extending parallel to the free faces of the slot-shaped columnar void. The rows of blasting holes are aligned with the vertical cleavage planes extending through the formation substantially parallel to the X-Z and Y-Z planes. The outer row of blasting holes defines the vertical sides of the retort being formed. Thus, the vertical sides of the retort are parallel to the vertical cleavage planes.

Other suitable methods of fragmenting formation containing oil shale are disclosed in aforementioned U.S. Pat. Nos. 4,043,597 and 4,043,598. According to methods disclosed in those patents, rooms or voids are excavated above and below a zone of formation to be fragmented. Blasting holes are drilled in this zone of unfragmented formation, the blasting holes are loaded with explosive, and the explosive is detonated for expanding formation into the adjacent voids.

In the practice of this invention, the blasting holes 19 in a zone of unfragmented formation can be arranged in rows and columns as illustrated in FIG. 3. In such case, explosive in the blasting holes is detonated in a proper sequence to fragment formation adjacent the void 12 and expand fragmented formation toward such void for forming a fragmented permeable mass of formation particles containing oil shale. This step of fragmenting the formation expands the formation and distributes the void volume of the voids into the interstices between the mass of fragmented formation particles.

Referring again to FIGS. 1 and 2, the entire length of the blasting holes is loaded from the void 12 with an explosive such as dynamite or ammonium nitrate mixed with fuel oil (ANFO). In the case of ANFO, about one to three net tons of formation per pound of ANFO can be fragmented. The explosive in the blasting holes is detonated in an outwardly progressing sequence, first the ring of blasting holes 14, then the ring of blasting holes 15, next the outer circular ring of blasting holes 16, and finally the approximately orthogonal band of blasting holes 17 that define the walls of the retort being formed. As further disclosed in U.S. Pat. No. 4,043,595 referred to above, the delay between between the detonations in the sequence is sufficiently large to permit the layer of formation created by detonating the explosive in each ring of blasting hole to completely break away from the unfragmented formation surrounding it and expand toward the raise, thereby creating a new free face prior to detonating the explosive in the next ring of blasting holes. However, the delay is not so large that the layers of fragmented formation fall appreciably before the blasting sequence is completed.

In an alternate embodiment, formation is fragmented without the use of a raise or a central bore hole. The location of the blasting holes is as described herein with time-sequenced detonators placed therein at selected horizontal levels. The detonators are detonated at each level sequentially progressing upwardly, so that formation is explosively expanded downwardly toward a free face at each sequential detonation. The sequential detonation at different levels is described in U.S. Pat. No. 3,661,423, which is assigned to the same assignee as this application.

As illustrated in FIG. 2, the outermost band of blasting holes 17 is aligned with cleavage planes extending through the formation parallel to the X-Z and Y-Z planes. Consequently, a smaller amount of explosive is required to fragment the formation satisfactorily, and the unfragmented formation that borders the in situ retort being formed provides substantially even surfaced side walls without large protrusions of unbroken formation.

Figure 5:
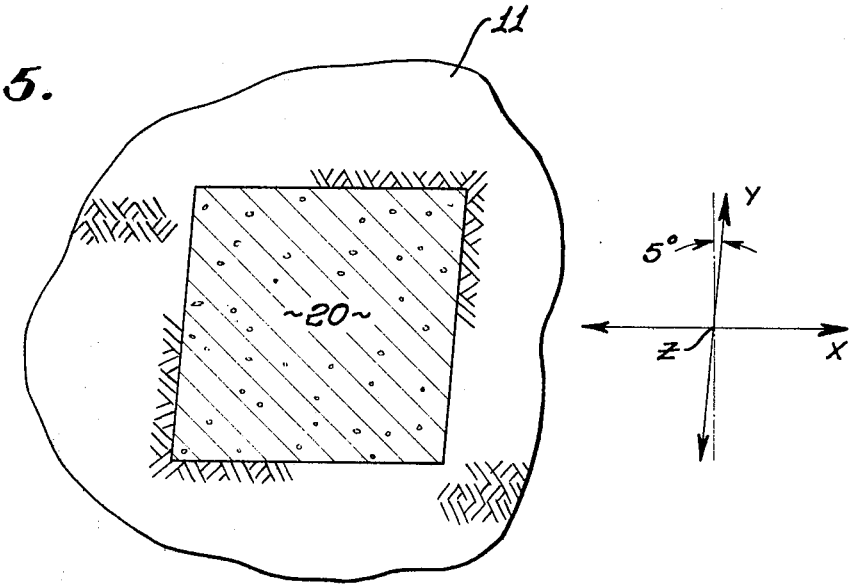
FIG. 5 is a horizontal cross-sectional view taken on line 5—5 of FIG. 4.

FIGS. 4 and 5 illustrate an in situ retort 20 after explosive expansion of formation, in which the retort contains a fragmented permeable mass of formation particles containing oil shale. The in situ retort 20 serves as a retort to produce shale oil from the mass of fragmented formation particles containing oil shale. Particles containing oil shale at the top of the fragmented mass are ignited to provide a combustion zone at the top of the fragmented mass. Air or other oxygen-supplying gas is supplied to the combustion zone by a compressor 21 to maintain and advance the combustion zone downwardly through the fragmented mass. Combustion gas generated in the combustion zone, including the non-oxidizing fractions of the air supplied to the fragmented mass, is moved from the combustion zone through the fragmented mass on the advancing side of the combustion zone to form a retorting zone where kerogen in the fragmented particles is converted to liquid and gaseous products. As the retorting zone moves down through the fragmented mass, liquid and gaseous products are released from the formation particles. The liquid percolates to the bottom of the fragmented mass where it is collected in a sump 22. The product gas from the retorting zone and combustion gas from the combustion zone flow downwardly and and withdrawn at the bottom of the fragmented mass as retort off gas. As indicated by lines 23 and 24, the liquids and retort off gas, respectively, are carried through a bulkhead 25 to ground level for utilization. If desired, off gas can be withdrawn from the bottom of the retort at a sufficient rate to draw oxygen-supplying gas into the top. In such an embodiment, means are provided for withdrawing off gas and the compressor 21 is deleted.

It also can be feasible to take greater advantage of the natural cleavage planes in the formation by aligning the sides of the raise 13 and the intermediate rings of blasting holes with the cleavage planes.

Thus, a raise having approximately orthogonal vertical sides can be formed in the central portion of the volume of formation, i.e., the retort site, in which the in situ retort is beong formed. A plurality of quadrangular bands of vertical blasting holes can be formed around the central raise with the explosive in each ring detonated sequentially for fragmenting formation surrounding the raise. The outermost band of blasting holes extends generally rectangularly for defining the vertical boundaries of the retort being formed. In such an embodiment, at least some of the rows of holes forming the bands of blasting holes are parallel to the substantially vertical cleavage planes extending through the formation where the retort is being formed.

The cleavage planes of subterranean formations containing oil shale are natural secondary structures which are generally developed by pressure and allow the formation to be more easily split along the cleavage planes than along other planes. The system of cleavage planes in such formations is three-dimensional and substantially orthogonal, with individual cleavage planes within a given cleavage plane set being relatively closely spaced apart through the formation. Thus, for example, in an extensive oil shale formation in the Piceance Basin of Colorado, one cleavage plane set is almost horizontal and extends parallel to the lower boundary of the formation, and two other cleavage plane sets are almost vertical and extend substantially perpendicular to the lower boundary of the formation. The dip of these formations containing oil shale is almost entirely less than about 3 degrees, although areas with a higher dip are known. The vertical cleavage planes can, therefore tilt slightly, but are substantially vertical. Generally they are close enough to vertical that substantially vertical blasting holes are satisfactory. The two vertical cleavage plane sets are substantially orthogonal, extending 87 degrees from each other; and therefore, it is preferred to form the in situ retort as a parallelogram with corner angles of 87 degrees and 93 degrees.

The cleavage planes are not always visible in the formation. They are merely planes of weakness along which the formation has a lower strength than in planes extending in other directions. It therefore takes less stress to fracture the formation on a plane parallel to the cleavage plane system, and most fractures induced in the formation are aligned with the cleavage plane systems. The principal directions of the cleavage planes can be determined by statistical analysis as mining is conducted. Thus, for example, as a tunnel or drift is excavated from an outcropping into a subterranean formation containing oil shale, the walls of the tunnel or drift have rock protrusions, many of which have substantially planar faces. The azimuth of a number of these planar faces is determined, and it is found through statistical analyses that the greater number of such faces are aligned with the cleavage planes of the formation. The principal cleavage planes also can be determined by surface mapping of cleavages in outcroppings, or by analysis of core samples. The individual in situ oil shale retorts formed in the formation containing oil shale are then aligned with the cleavage planes found by such statistical analysis.

The system of cleavage planes is to be distinguished from slip planes that also may be present in various rock formations. The slip planes occur due to stress arising outside the formation. Within localized regions, such slip planes may be generally parallel to each other, but in regions a few hundred feet away, the slip planes may extend in a completely different direction due to localized forces. Thus, the slip planes in a formation extend in generally random directions, whereas the cleavage plane systems are substantially constant over long distances in a formation containing oil shale.

EXAMPLE 1

A drift is extended into a subterranean formation containing oil shale at about the lower boundary of the formation, and a second drift is excavated into the subterranean formation above the lower drift and about 80 feet below the upper boundary of the portion of the formation to be processed. The floor of the upper drift is aout 260 feet above the floor of the lower drift. A void which is about 120 feet square and 30 feet high is excavated in the formation with access through the upper drift. The void has its walls aligned with vertical cleavage planes extending through the formation. The lower drift is excavated under the middle of the void and branch drifts are extended under each quadrant of the void.

Raises extending through each quadrant of the in situ retort being formed are excavated by first boring four-foot diameter raises from each of the branch drifts upward toward the center of each quadrant of the void. These raises are substantially parallel and the longitudinal axes of the raises are parallel to the vertical cleavage planes of the formation. These raises are enlarged to 30 feet in diameter by drilling blasting holes into the formation surrounding each raise. The blasting holes extend parallel to the raises and are spaced in concentric rings around the raises such that formation fragmented by detonating explosive in the blasting holes in the concentric ring closest to the raise will expand toward the center of the raise and have a sufficient void volume to move toward the bottom of the raise. The raises extending from the lower drift to within about 30 feet below the floor of the void are enlarged by this technique.

Blasting holes are then drilled in unfragmented formation around each raise and above the void. The blasting holes around the raises are drilled parallel to the raises and hence are aligned with vertical cleavage planes extending through the formation. The blasting holes furthest removed from each raise are in bands parallel to the vertical cleavage planes and define the quadrants of the in situ retort being formed. Blasting holes also are formed in the layer of unfragmented formation between the top of each raise and the floor of the void above it. The blasting holes in the formation above the void extend vertically, with the holes extending from the center of the void being longer than the holes extending from the sides of the void to produce a domed top on the retort being formed.

The blasting holes are loaded with explosive and appropriate detonators. The explosive is detonated in the following rapid sequence. Formation between the top of the raises and the floor of the void is first explosively expanded with a conventional V-cut so as to lift most of the formation into the overlying void. Formation around the raises is then fragmented by first detonating explosive in the blasting holes closest to the raises to cause the formation to fracture and expand toward the raises to fragment the formation. Time delays between adjacent blasting holes in each ring can be used to aid in fragmenting the formation. Before the fragmented formation begins to fall toward the bottom of the raises, explosive in the remaining series of blasting holes is detonated in sequence to fracture the remaining formation and to expand the formation toward the raise. By this procedure, formation surrounding the raises is expanded toward the raises to form a fragmented permeable mass of formation particles below the void with a void volume of about 20% of the volume of that part of the in situ retort. Explosive in the blasting holes extending into formation above the void is then detonated to explosively expand such formation into the void. This produces an in situ oil shale retort with fairly even surfaced vertical walls and a fragmented permeable mass of formation particles containing oil shale extending from the top to the bottom of the in situ retort site. The upper boundary of the fragmented mass is formed by the rock or other unfragmented formation or overburden above that portion of the formation that is fragmented by explosive charges. The fragmented mass is bounded at the bottom by unfragmented formation which has not been disturbed by mining or explosive charges.

An access conduit is formed to the center of the top of the fragmented mass. Gas is introduced through the access conduit and is moved to the bottom of the in situ retort where it is withdrawn through the drift extending to the bottom of the fragmented mass. A combustible gaseous mixture of propane and air is introduced through the access conduit and is ignited to initiate a combustion zone in the top of the fragmented mass. Other combustible gaseous mixtures of oxygen and fuel also are suitable. The supply of the combustible gaseous mixture to the combustion zone is maintained for about one week. At the end of about one week, the formation particles at the top of the fragmented mass have been heated to a temperature greater than about 900 degrees F. so that combustion can be maintained by introducing air into the combustion zone.

The combustion zone is maintained and advanced through the fragmented mass toward the sides and bottom by introducing an inlet gas through the access conduit and moving the inlet gas toward the bottom of the fragmented mass. A suitable inlet gas is a mixture of air and retort off gas or water vapor having an oxygen content of about 10% to 20% of the volume of inlet gas. The inlet gas is moved through the fragmented mass at about 0.5 to 2 standard cubic feet of gas per minute per square foot of cross-sectional area of the fragmented mass.

The movement of gas through the fragmented mass carried the combustion gas generated in the combustion zone through the fragmented mass and establishes a retorting zone on the advancing side of the combustion zone. In the retorting zone, kerogen in the fragmented formation particles is converted to liquid and gaseous products. The liquid products move by gravity to the bottom of the fragmented mass where they are recovered, and the gaseous products mix with the gas moving through the fragmented mass and are removed as retort off gas from the bottom of the fragmented mass. The retort off gas is the gas removed from the bottom of the fragmented mass and includes inlet gas, combustion gas generated in the combustion zone, and product gas generated in the retorting zone.

In another embodiment of this example, a fragmented mass is formed in a similar manner, and a retorting zone is passed downwardly through the fragmented mass with heated retorting gas. Heated gas substantially free of oxygen is introduced through the access conduit at the top of the fragmented mass. This heats the formation particles and decomposes the kerogen in them to yield shale oil and gaseous products which are recovered at the bottom of the fragmented mass. Heat from the retorting gas progressively heats formation particles at a lower level in the fragmented mass so that the retorting zone progressively moves downwardly through the fragmented mass. The heated retorting gas introduced at the top of the fragmented mass can be off gas from a previously retorted in situ retort into which air is introduced to burn carbonaceous material in the spent shale.

EXAMPLE 2

Figure 6:
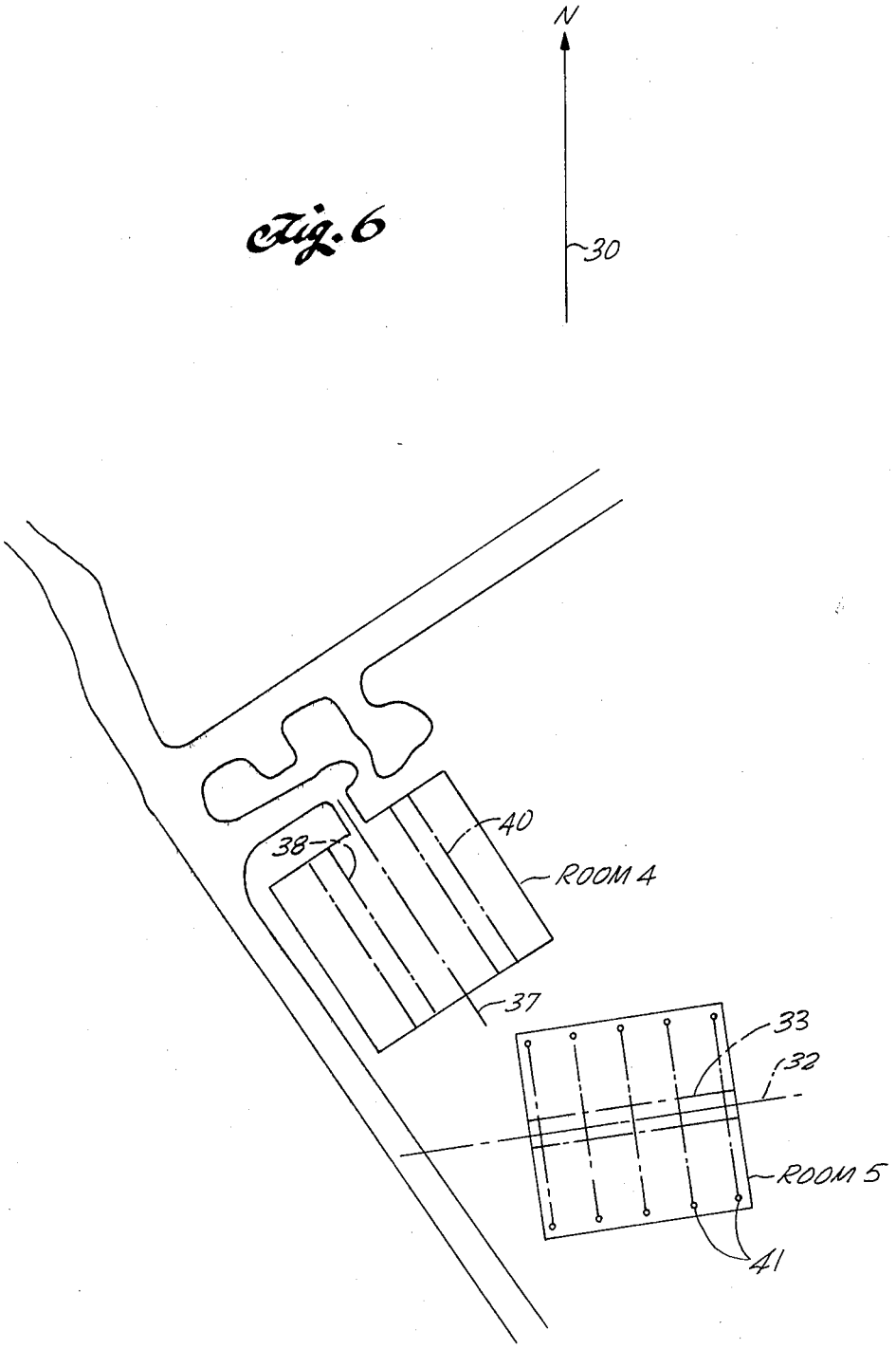
FIG. 6 is a plan view illustrating the relative orientations of a pair of experimental in situ oil shale retorts.

Two in situ oil shale retorts were formed in an experimental project for in situ retorting of oil shale at Logan Wash in the southwest part of the Piceance Creek Basin north of DeBeque, Col. For convenience these two in situ oil retorts are referred to as Room 4 and Room 5, respectively. FIG. 6 illustrates a fragment of a map of underground workings at the Logan Wash site illustrating the relative orientations of Rooms 4 and 5. North is in the direction of the arrow 30 shown in FIG. 6. A line 32 is shown drawn through Room 5 parallel to a vertical slot 33 excavated in the Room 5 retort site. The line 32 is parallel to the length of the slot 33 and has an azimuth or bearing of about 82 degrees. A similar line 37 drawn through Room 4 parallel to slots 38 and 40 has a bearing of about 135 degrees.

Rooms 4 and 5 each have a design height in excess of 200 feet and a horizontal cross section of about 120 feet square. Each retort contains a fragmented permeable mass of formation particles containing oil shale. The actual dimensions of the in situ oil shale retorts can differ somewhat from design due to complications and/or normal variations in excavating and blasting to form the retorts.

Two slots, each having a rectangular horizontal cross section of 12 feet by 120 feet, were planned within the retort site for Room 4. The projected cross section of the two slots was 20% of the horizontal cross section of Room 4. That is, it was planned that when formation within the boundaries of the retort being formed as Room 4 was explosively expanded toward the slots to form a fragmented permeable mass of formation particles, the void fraction in the portion expanding toward the slots would be about 20% of the volume of the fragmented mass. Actual construction resulted in an in situ oil shale retort having a fragmented permeable mass of particles with a substantially larger than projected void fraction.

Figure 7:
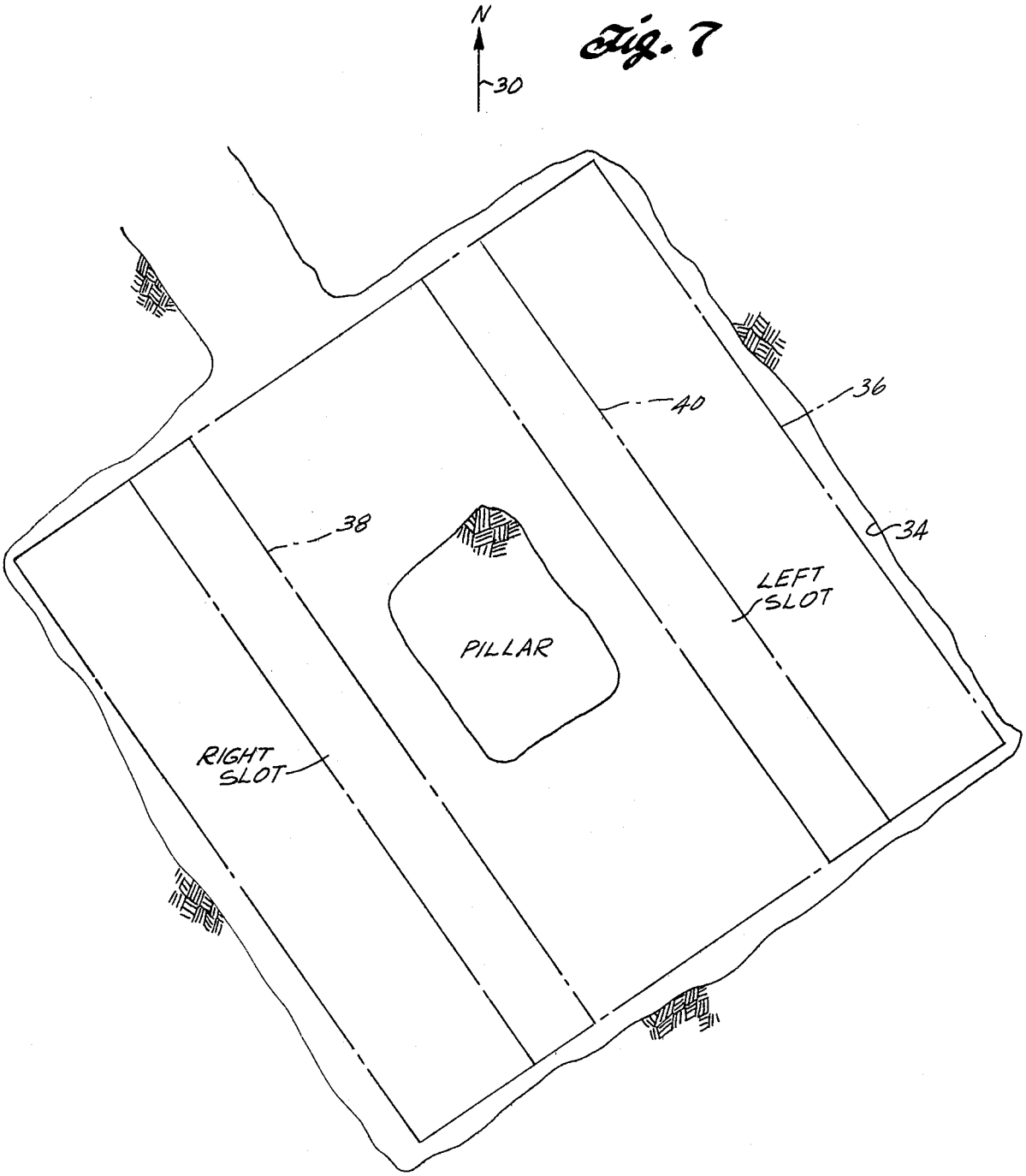
FIG. 7 is a schematic cross sectional plan view illustrating a void excavated at an upper level of one of said experimental in situ retorts, with planned locations of left and right vertical slots being shown in phantom lines.

In forming Room 4, a lower level access drift was excavated to a lower portion of the Room 4 site. A void about 130 feet square was excavated at an upper level of the Room 4 site. A large central pillar for roof support was left within the upper level void. FIG. 7 illustrates the excavated void 34 at the upper level superimposed on a phantom line outline 36 of the in situ oil shale retort being formed. The planned locations of a right slot and a left slot are also shown in phantom lines 38 and 40, respectively.

Figure 8:
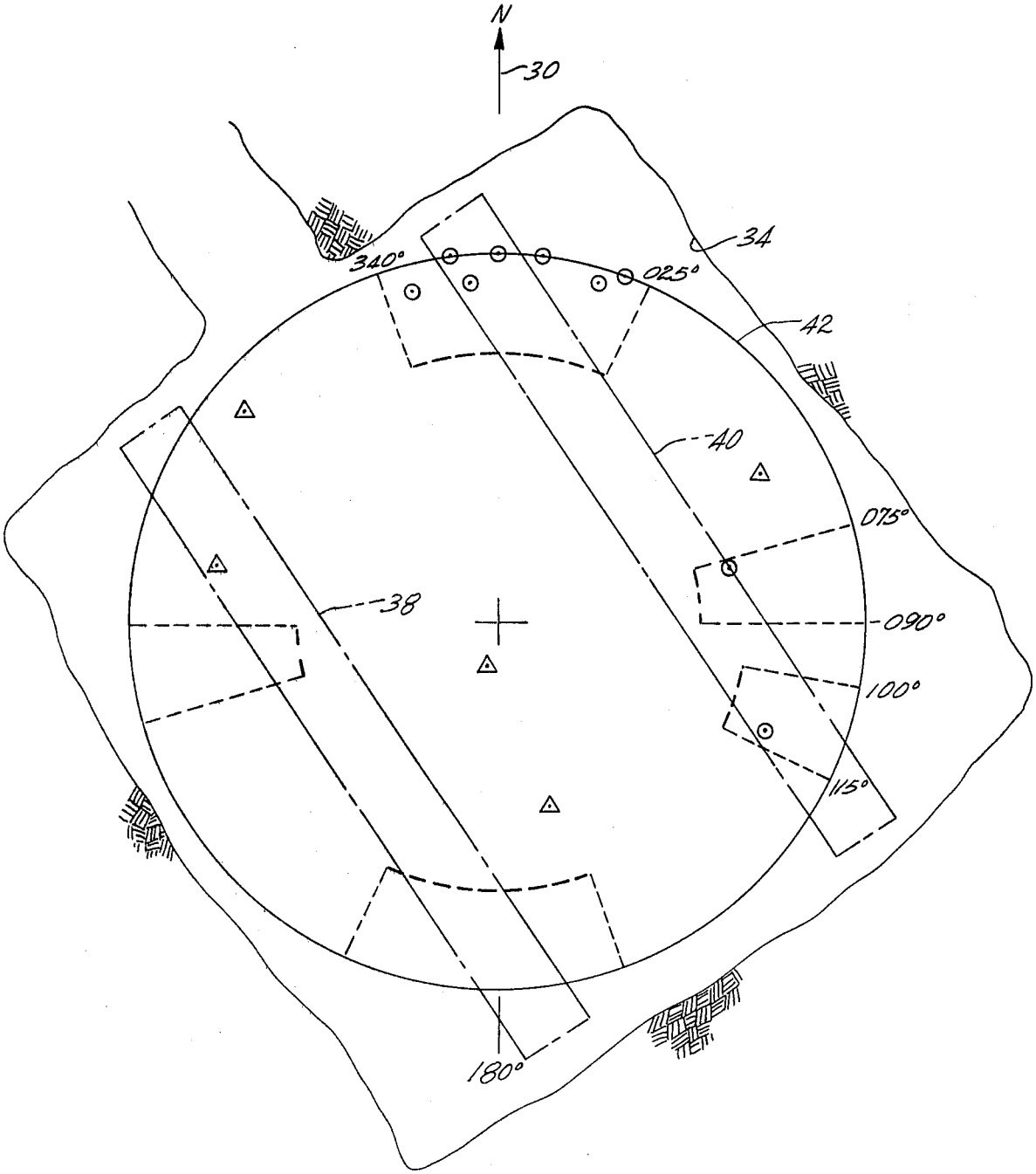
FIG. 8 is a fracture set diagram superimposed on an upper level void as illustrated in FIG. 7.

FIG. 8 illustrates a generalized fracture set diagram which is derived from a standard stereographic projection. The diagram is superimposed on a sketch of the upper level void 34 for Room 4 with the planned locations of the right and left slots 38 and 40. The fracture set diagram indicates the strike and dip of significant cleavage plane sets noted in excavations in the oil shale formation at the Logan Wash site.

Data for constructing the fracture set diagram was obtained from surveying exposed fracture faces in excavated portions of the formation containing oil shale. Substantially flat faces on the walls of excavated spaces are surveyed to determine their strike and dip. When the orientations of a number of such fracture faces are plotted on a fracture set diagram, the strike and dip of the cleavage plane systems in the formation become apparent.

Strike is the direction or bearing of a horizontal line in the plane of an inclined stratum, joint, fault, cleavage plane or other structural plane; it is perpendicular to the direction of the dip. Dip is the angle at which such a structure is inclined from the horizontal.

The fracture set diagram is in the form of a circle 42 with azimuth or bearing portrayed around the circumference of the circle, with north at the top, as illustrated by the arrow 30, east at the right, south at the bottom, and west at the left. The strike of the surveyed cleavage planes is plotted at the appropriate azimuthal location. The dip of the cleavage planes is indicated by radial position, with horizontal being in the center of the circle. A 90 degrees dip is vertical. A few cleavage planes larger than about 10 feet in length are plotted on the fracture set diagram shown in FIG. 8; a large number of smaller cleavage planes also were plotted in forming the fracture set diagram, but they are not individually shown in FIG. 8.

The summary shown in the fracture set diagram represents a statistical analysis of a stereographic plot. Such analysis shows that the formation at the Logan Wash site has a principal cleavage plane set with a dip of nearly 90 degrees and an azimuth between about 340 degrees and 25 degrees. degrees.

A secondary cleavage plane set has a bearing or azimuth between 75 degrees and 90 degrees. These cleavage planes occur with a dip of more than 50 degrees. This secondary cleavage plane set is substantially orthogonal to the principal cleavage plane set. A minor fracture set also was noted with a strike between 100 degrees and 115 degrees and more than 60 degrees dip.

The slots 38 and 40 in the Room 4 site were started by drilling down from the upper level void 34 to the lower level access drift and raise boring to form a four foot diameter circular raise. Fragmented formation particles from forming the raise were excavated through the lower level access drift.

Blasting holes substantially parallel to the raise were then drilled from the upper level void 34. These blasting holes each had a diameter of four and one-half inches. The blasting holes were loaded with an ammonium nitrate-fuel oil (ANFO) explosive for enlarging the raise and extending the slot. Explosives in three such holes were detonated in a single round for enlarging the raise. A powder factor of over six pounds of ANFO per ton of formation being blasted was used. Fragmented formation particles resulting from the blasting were withdrawn through the access drift at the lower level.

To further enlarge the raise and form a slot, blasting holes were drilled downwardly parallel to the enlarged raise. A row of three holes perpendicular to the width of the slot being formed was detonated in each round with a burden of about ten feet. The powder factor was about two pounds of ANFO per ton of formation being blasted. The fragmented formation particles from blasting were withdrawn through the access drift at the lower level. This drilling and blasting sequence was repeated to enlarge the slots to the full 120-foot width of the retort being formed. The slots in Room 4 had a bearing of about 135 degrees.

The slots for Room 4 did not maintain their design width, and they continued to widen as the walls of the slots continued to fail after parts of the slot were excavated. Time became important during formation of Room 4 because the walls of the slots continually sloughed off and blasting of the remaining formation in the retort site could not be postponed. Further, because of the fractures extending from the slots into adjacent formation, and the resulting weak rock condition in the walls of the slots, excavation of fragmented particles in the bottoms of the slots could not be completed. Additional slabs of formation would break out of the walls as the level of fragmented particles in the slots was lowered. Intersection of the principal cleavage plane set with the walls of the slots at an acute angle aggravated the backbreakage by providing planes of weakness along which the formation was fractured and could fail and slough off. Fractures aligned with the principal cleavage plane set at an acute angle to the walls of the slots caused wedge-shaped sections of formation to slough off and fall into the slots.

Figure 9:
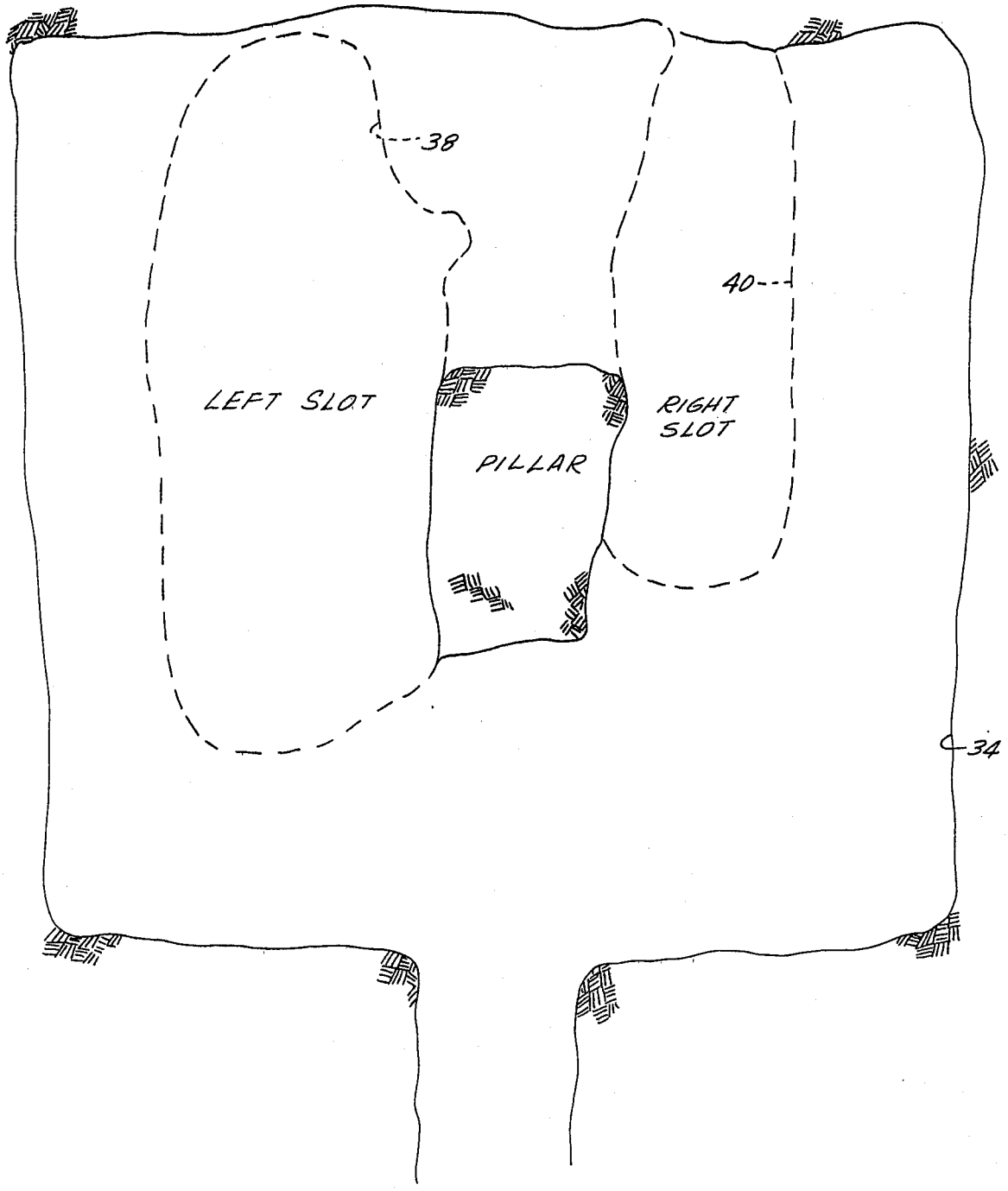
FIG. 9 is a schematic plan view illustrating the estimated size and shape of the right and left slots, following slot formation, at an upper level of the experimental retort being formed.
Figure 10:
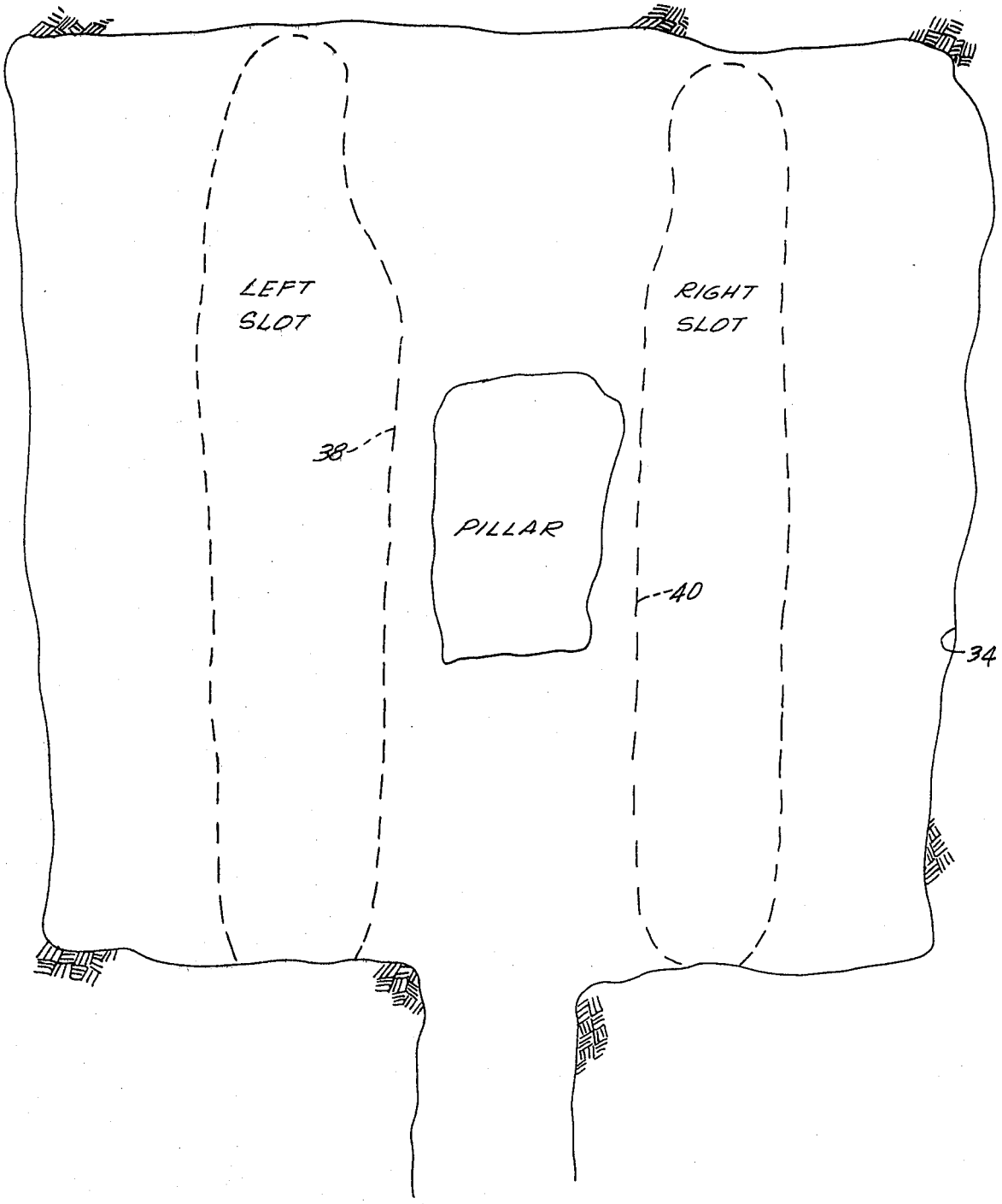
FIG. 10 is a schematic cross-sectional plan view similar to FIG. 9 showing the left and right slots at an intermediate level.
Figure 11:
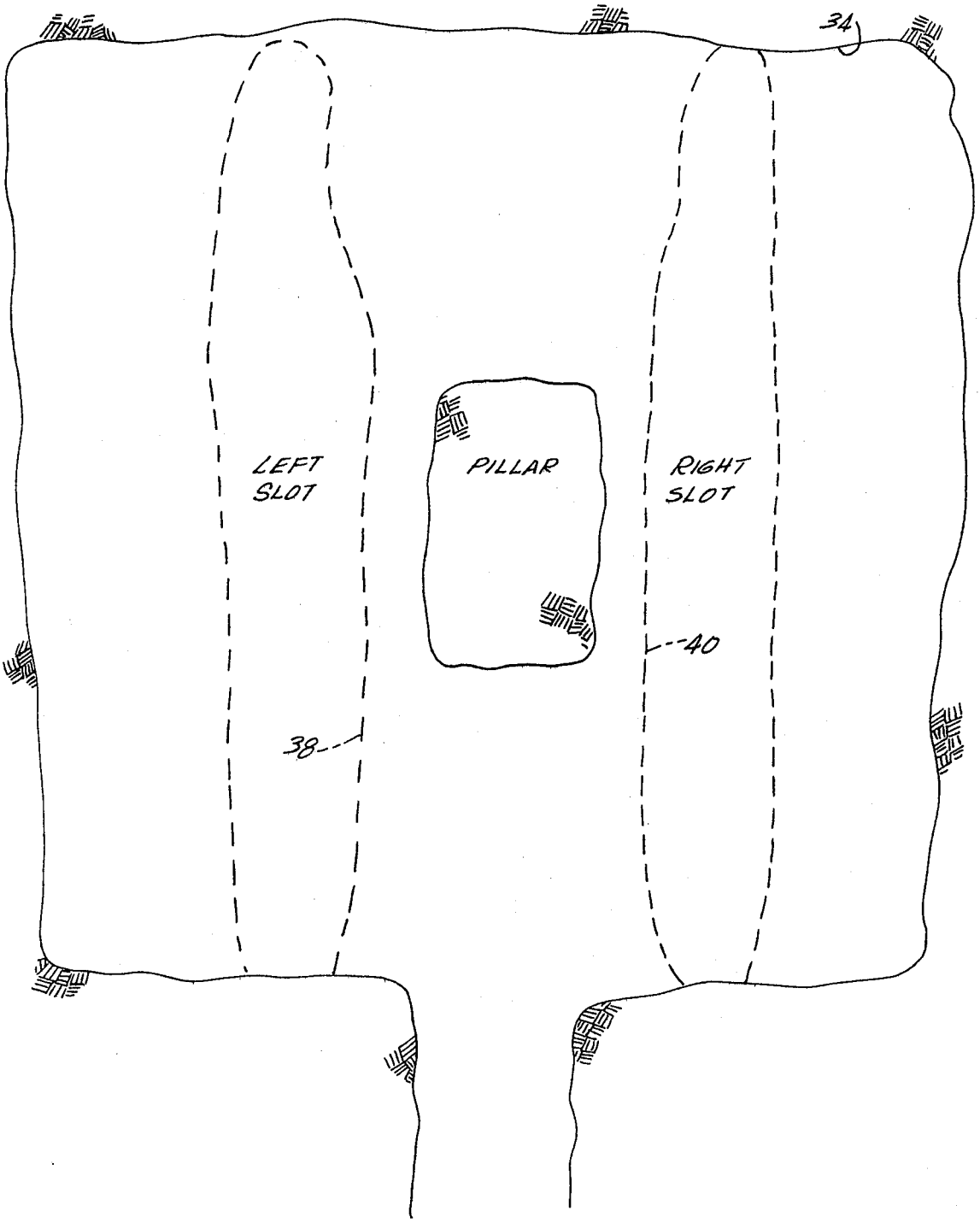
FIG. 11 is a schematic cross-sectional plan view similar to FIG. 9 showing the left and right slots at a lower level.

The final shape of the slots 38 and 40 is illustrated in FIGS. 9, 10 and 11. In each of these illustrations, shapes and sizes of the slots were estimated from long range visual inspection, inasmuch as safety considerations precluded actual measurements. FIG. 9 illustrates the estimated size and shape of the slots at a level about 20 to 30 feet below the floor of the void at the upper level. FIG. 10 illustrates the estimated shape of the slots at about 100 to 120 feet below the floor of the upper level void. FIG. 11 illustrates the estimated shape and size of the slots about 160 to 180 feet below the floor of the upper level void. It will be noted that the top of each slot was terminated at a level below the floor of the upper level void 34 in an area near the upper access drift into the void. This left a portion of the floor of the upper level void intact for access by men and equipment.

Fragmentation and distribution of void volume in the fragmented permeable mass after explosive expansion were not considered completely satisfactory. This was at least partly due to problems in loading explosive into blasting holes which resulted in poor distribution of explosive in the formation to be fragmented.

A single slot 33 was excavated for forming the in situ retort known as Room 5. Room 5 was oriented with the walls of the single slot 33 substantially parallel to the secondary cleavage plane set, which was approximately normal to the principal cleavage plane set. The secondary cleavage plane set has a bearing between about 75 degrees and 90 degrees. The azimuth or bearing of the walls of the slot in Room 5 was about 82 degrees. The drill hole diameter for slot blasting was three and $\frac{5}{8}$ inches, thereby overloading and resultant backbreakage of the remaining rock was minimized. A top or sill pillar of unfragmented formation about 40 feet thick was left between the top of the slot and the floor of the upper level void to eliminate an upper free face adjacent the top of the slot such as was present at the floor of the upper level void 34 in Room 4.

An access drift was excavated to the lower level of the Room 5 retort site for withdrawing fragmented formation particles resulting from forming the slot. A generally E-shaped void was excavated at an upper level to provide access over the top of most of the 120 foot square retort site. The center arm of the E-shaped void extended over the slot. The slot was designed to have a width of about 18 feet and to extend about 120 feet between the sides of the retort being formed. The horizontal cross-sectional area of the slot was designed to be 15% of the cross-sectional area of the retort. The slot was started by drilling and boring a four-foot diameter raise as was used for starting the slots in Room 4. Rows of three blasting holes were used for enlarging the Room 5 slot lengthwise in the same general manner as in forming the slots in Room 4. The drill hole diameter for slot blasting was three and $\frac{5}{8}$ inches, thereby minimizing overloading and resultant overbreaking of the remaining rock. The lower portions of the drill holes were loaded with explosive up to about 40 feet below the level of the E-shaped void at the upper level. Thus, the top of the slot was separated from the floor of the upper level void by about 40 feet of unfragmented formation. Additional details of a technique used in forming Room 5 are set forth in U.S. patent application Ser. No. 790,350, filed Apr. 25, 1977, by Ned M. Hutchins, now U.S. Pat. No. 4,118,071. That application is incorporated herein by this reference.

By aligning the slot in Room 5 with one of the cleavage plane sets in the formation, backbreakage problems were not aggravated and sloughing of rock from the walls was minimized. The slot in FIG. 5 was not affected significantly by time, as were the slots 38 and 40 in Room 4. The slot in Room 5 stood open for seven months without noticeable change. No substantial problems were encountered in loading explosive in blasting holes 41 for explosive expansion of the remaining formation in Room 5 toward the slot. As shown in FIG. 6, the rows of blasting holes 41 were aligned approximately parallel to the free faces of the vertical slot, and thus, there were aligned with the vertical cleavage planes extending through the retort site. The outer row of blasting holes defined the vertical sides of the retort formed, and thus, the vertical walls of unfragmented formation at the boundary of the retort were parallel to the vertical cleavage planes. The blasting for explosive expansion went off as scheduled on Dec. 16, 1976.

A primary reason for failure of the walls and consequent widening of slots 38 and 40 in Room 4 is believed to be the misalignment of the walls of the slots with the cleavage planes along which the formation preferentially fractured. Other factors, such as overloading of explosive in the blasting holes for enlarging the slots, and the opening at the top of the slots into the floor of the upper level void, and are believed to have had no appreciable influence on the failure of the walls and the widening of the slots in Room 4.

The failure of the walls in the Room 4 slots is believed to have been primarily a result of the misalignment of the slots with the widely dispersed principal cleavage plane set existing in the formation where Room 4 was formed. In many types or rock other than oil shale, orientation of individual cleavage planes in a given cleavage plane set are tightly grouped and exhibited limited angular dispersion of cleavage planes within such a set. It is believed that oil shale (marlstone) is an unusual rock when compared with some other types of rock. It can have unusually high angular dispersion of individual cleavage planes within a given cleavage plane set when compared with some other types of rock; and as a result, it can exhibit an unusual behavior when fractured during explosive expansion to form a slot or fragmented mass in a retort.

For example, the Green River formation at the Logan Wash site has two major cleavage plane sets having different dispersion characteristics. The principal cleavage plane set, namely, the generally north-south cleavage plane set, has a relatively wide dispersion, in both strike and dip, of individual cleavage planes within the cleavage plane set. The secondary cleavage plane set, namely, the generally east-west cleavage plane set, has a lower dispersion, in strike, than the principal cleavage plane set. A wide dispersion of individual cleavage planes within a given cleavage plane set provides the possibility of intersection between cleavage planes within the same set. Such a wide dispersion also provides the possibility of wedges of formation being formed between the cleavage planes and the vertical side walls of the slot, particularly if the cleavage planes intersect the side walls at angles of 30 degrees of less. The misorientation of the long axis of the slots in Room 4 with respect to the widely dispersed principal cleavage plane set contributed significantly to the instability of the walls of the slots in Room 4. Such instability was further affected adversely by the dispersion of cleavage planes, in dip, in both sides of the vertical direction of the principal cleavage plane set, as well as between such cleavage planes and the vertical walls of the slots. Such wedges could slough off into the slots.

The slot in Room 5 was aligned substantially perpendicular to the principal cleavage plane set, inasmuch as the vertical walls of the slot were parallel to the generally east-west, i.e., secondary cleavage plane set. This orientation of the slot resulted in relatively even-surfaced and stable side walls when compared with the slots in Room 4. Since the secondary cleavage plane set had relatively low dispersion, few cleavage planes intersected the walls at low angles, and wedges of formation which can slough off were minimized.

There were differences between the conditions under which the Room 4 and Room 5 slots were formed, other than the different orientations with respect to the formation cleavage planes. Such other factors were overloading of explosive in the blasting holes for enlarging the slots of Room 4, and the presence of a free face at the top of the slots in Room 4. These factors are believed to have had much less effect on the failure of the walls and consequence widening of the slots in Room 4, as compared with Room 5. The amount of explosive used in forming the vertical slot for Room 5 was approximately 20% to 40% less per unit quantity of unfragmented formation than the amount used in forming the slots in Room 4. It was thought that overloading of the explosive contributed to the failure of the walls in the Room 4 slots, in that such overloading caused appreciable backbreakage, or overbreak, into the walls of the Room 4 slots, causing fractures to extend from the slot into the formation adjacent the slot. However, from subsequent geological analysis it is believed that the effect of overbreak from the blasting holes is limited to a finite distance, with such rock damage being nominally about five feet into the formation from the blast-formed opening. Such rock damage depth data has been confirmed by test work done in the determination of in situ rock stresses in formations containing oil shale. The limit of rock overbreak and spalling in cases not affected by fracture orientation is nominally about five feet. Comparisons of the Room 4 overbreak as compared to Room 5 indicate that the major factor in the failure of the walls in Room 4 was the misalignment of thre slots with the cleavage planes. Deterioration of the walls in the Room 4 slots exceeded five feet, indicating that such deterioration was caused by adverse cleavage plane orientations, and not overloading of explosive.

A horizontal free face was present at the top of the Room 4 slots. The slots opened into the floor of the upper level void in Room 4. The top of the vertical slot in Room 5 was confined by a horizontal sill pillar of unfragmented formation present at the top of the slot. It was thought that the floor of the upper level void, which provided an additional free face in Room 4, allowed additional fracturing along cleavage planes adjacent the floor of the upper level void. However, subsequent geological analysis has shown that the confining effect of the sill pillar in Room 5 is limited to the width of the vertical slot down the slot from the sill pillar. That is, the effect of the closed top in the slot in Room 5 would protect only the top 15 feet of the slot wall from sloughing. Mid-portions of the vertical slot, which are four to eight times this distance, are unaffected by the effects of end confinement at the top of the slot. Thus, the failure of the walls in the Room 4 slots is attributed to the orientation of the slots relative to the cleavage planes in the formation, and not any effects of a free face present at the top of the slots.

What is claimed is:

1. A method of forming, in a subterranean formation containing oil shale, an in situ oil shale retort having side walls of formation aligned with substantially vertically inclined subterranean formation cleavage planes, and containing a fragmented permeable mass of formation particles containing oil shale, which comprises the steps of:

excavating at least one void in the subterranean formation containing oil shale and leaving a remaining portion of unfragmented formation within the side boundaries of the in situ retort being formed;

placing explosive in the oil shale in at least one row of blasting holes parallel to such a substantially vertical formation cleavage plane for preferentially fracturing said formation along the substantially vertical formation cleavage planes and expanding said remaining formation toward such a void; and detonating explosive for fracturing at least a portion of the formation along said substantially vertical formation cleavage planes and expanding said remaining formation toward such a void for fragmenting said remaining formation.

2. A method of forming, in a subterranean formation containing oil shale, an in situ oil shale retort having side walls of formation aligned with substantially vertically inclined subterranean formation cleavage planes, and containing a fragmented permeable mass of formation particles containing oil shale, which comprises the steps of:

excavating at least one void in the subterranean formation containing oil shale and leaving a remaining portion of unfragmented formation within the boundaries of the in situ retort being formed, wherein such a void extends substantially vertically in said oil shale formation, the surface of the unfragmented formation defining such a void providing at least one free face extending substantially vertically in the retort site, the longitudinal axis of such a void extending substantially parallel to said substantially vertically inclined formation cleavage planes;

placing explosive in the oil shale in at least one row of blasting holes substantially parallel to such a vertically inclined formation cleavage plane for preferentially fracturing said oil shale formation along such vertically inclined formation cleavage planes and expanding said remaining formation toward such a free face; and detonating explosive for fracturing at least a portion of the formation along said vertically inclined formation cleavage planes and expanding said remaining formation toward such a free face for fragmenting said remaining formation.

3. A method of forming, in a subterranean formation containing oil shale, an in situ oil shale retort having side walls of unfragmented formation aligned with substantially vertically inclined subterranean formation cleavage planes, and containing a fragmented permeable mass of formation particles containing oil shale, which comprises the steps of:

excavating at least one void extending substantially vertically in said subterranean formation containing oil shale, the surface of the unfragmented formation defining such a void providing at least one free face extending substantially vertically in the retort site, the longitudinal axis of such void extending substantially parallel to said vertical formation cleavage planes and leaving a remaining portion of unfragmented formation within the boundaries of the in situ retort being formed;

placing explosive in blasting holes extending into the formation adjacent said boundaries parallel to such a free face in a position for preferentially fracturing said formation along the substantially vertical formation cleavage planes and expanding said remaining formation toward such a void, at least a portion of said blasting holes being spaced in bands parallel to said vertical formation cleavage planes; and detonating said explosive for fracturing at least a portion of the formation along said substantially vertical formation cleavage planes and expanding said remaining formation toward such a void for fragmenting said remaining formation.

4. A method of forming, in a subterranean formation containing oil shale, an in situ oil shale retort having side walls of unfragmented formation aligned with substantially vertically inclined subterranean formation cleavage planes, and containing a fragmented permeable mass of formation particles containing oil shale, which comprises the steps of:

excavating a room in the subterranean formation containing oil shale and leaving a remaining portion of unfragmented formation within the boundaries of the in situ retort being formed;

placing explosive in blasting holes extending substantially vertically from the room into the formation adjacent said boundaries in a position for preferentially fracturing said formation along the substantially vertical formation cleavage planes and expanding at least a portion of said remaining formation toward said room, at least a portion of said blasting holes being spaced in bands parallel to said vertical formation cleavage planes; and detonating said explosive for fracturing at least a portion of the formation along said substantially vertical formation cleavage planes and expanding at least a portion of said remaining formation toward said room for fragmenting said remaining formation.

5. A method of retorting oil shale in an in situ oil shale retort in a subterranean formation containing oil shale and recovering liquid and gaseous products therefrom wherein the in situ oil shale retort has side walls of unfragmented formation aligned with substantially vertical subterranean formation cleavage planes and containing a fragmented permeable mass of formation particles containing oil shale, which comprises the steps of:

excavating a void in the subterranean formation containing oil shale and leaving a remaining portion of unfragmented formation within the boundaries of the in situ retort being formed;

placing explosive in the formation adjacent said boundaries in a position in said formation for preferentially fracturing said formation along the substantially vertical formation cleavage planes and for expanding said remaining formation toward said void;

detonating explosive for fracturing at least a portion of said formation along said substantially vertical formation cleavage planes and expanding said remaining formation toward said void for fragmenting said remaining formation and thereby forming an in situ oil shale retort having side walls of unfragmented formation aligned with substantially vertical formation cleavage planes and containing a fragmented permeable mass of formation particles containing oil shale;

providing gas access means at the top of the fragmented mass;

igniting formation particles at the top of the fragmented mass for providing a combustion zone at the top of the fragmented mass;

introducing an oxygen supplying gas through said gas access means to said combustion zone for maintaining said combustion zone and for advancing said combustion zone toward the lower boundary of the fragmented mass;

moving the combustion gas generated in said combustion zone through the fragmented mass on the advancing side of said combustion zone for providing a retorting zone on the advancing side of said combustion zone wherein kerogen in the formation particles is converted to liquid and gaseous products; and recovering the liquid and gaseous products at the lower boundary of the fragmented mass.

6. A method as recited in claim 5, wherein said void extends substantially vertically through said formation, the surface of the unfragmented formation defining such a void providing at least one free face extending substantially vertically in the retort site, and the longitudinal axis of such a void extends substantially parallel to such substantially vertical formation cleavage planes.

7. A method as recited in claim 6, wherein said explosive is placed in blasting holes extending through the formation substantially parallel to such a free face, and wherein at least a portion of said blasting holes are spaced in bands aligned with said substantially vertical formation cleavage planes.

8. A method as recited in claim 5, wherein said void is a room in the subterranean formation containing oil shale;

said explosive is placed in blasting holes extending vertically from the room into the formation; and at least a portion of such blasting holes are spaced in bands aligned with such substantially vertical formation cleavage planes.

9. A method for forming an in situ oil shale retort in a subterranean formation containing oil shale and having a pair of approximately orthogonal formation cleavage planes comprising the steps of:

removing formation to form a quadrangular room having sides aligned with the formation cleavage planes and leaving a remaining portion of unfragmented formation within the boundaries of the in situ retort site;

drilling a plurality of elongated blasting holes into the remaining portion of the formation;

loading the blasting holes with explosive; and detonating the explosive for fragmenting and expanding the remaining portion of the formation to form a region of fragmented particles containing oil shale bordered by sides aligned with the formation cleavage planes.

10. The method of claim 9 in which the plurality of blasting holes includes a quadrangular band of side defining blasting holes arranged around the periphery of the room in alignment with the formation cleavage planes.

11. The method of claim 10, in which the remainder of the plurality of blasting holes are arranged within the band of side defining blasting holes in rows and columns in alignment with the formation cleavage planes.

12. The method of claim 10 further comprising the step of forming a substantially vertically extending void having an axis substantially aligned with the formation cleavage planes within the band of side-defining blasting holes.

13. The method of claim 9, additionally comprising the step of forming a substantially vertically extending void that extends from the room with its axis substantially parallel to the formation cleavage planes, the plurality of blasting holes being arranged around the void in a plurality of coaxial rings one inside another and including an outermost band of blasting holes alinged with the formation cleavage planes, the detonating step comprising detonating explosive in the blasting holes of each ring progressing sequentially in an outward direction from the void.

14. The method for fragmenting subterranean formation containing oil shale to form an in situ oil shale retort bounded by walls of unfragmented formation and containing a fragmented permeable mass of formation particles containing oil shale in a subterranean formation having a pair of approximately orthogonal formation cleavage plane systems comprising the steps of:

removing formation to form a room having a floor plan at least in part corresponding to the cross section of the in situ retort to be formed;

removing formation to form a raise that extends transversely from the room, the raise having an axis substantially parallel to the principal formation cleavage plane system;

drilling a plurality of coaxial closed bands of blasting holes in the formation one inside another around the raise and extending generally parallel thereto, at least the outermost band of blasting holes being aligned with the principal formation cleavage plane system;

loading the blasting holes with explosive; and detonating the explosive for fragmenting formation within the outermost band of blasting holes and expanding the formation toward the raise and the room to form a fragmented permeable mass of formation particles containing oil shale.

15. The method for recovering carbonaceous values from a region of a subterranean formation containing oil shale having first and second approximately vertical, approximately orthogonal formation cleavage plane systems comprising the steps of:

determining the principal directions of the first and second formation cleavage plane systems;

forming an in situ retort comprising a fragmented permeable mass of formation particles containing oil shale bounded by approximately vertical side walls of formation substantially parallel to the first and second formation cleavage plane systems by the steps of:

forming a room having quadrangular sides approximately parallel to the principal formation cleavage plane system in the volume to become the in situ retort, the room being at least as large as the cross section of the in situ retort being formed, and leaving a remaining portion of the formation within the volume to become the in situ retort, drilling a plurality of blasting holes from the room into the remaining portion of formation, the blasting holes including a quadrangular band of side-defining blasting holes arranged around the periphery of the room approximately parallel to the principal formation cleavage plane system;

loading the blasting holes with explosive, and detonating the explosive to fragment the remaining portion of formation and form a fragmented permeable mass of formation particles containing oil shale;

introducing at the top of the fragmented mass a retorting gas for releasing carbonaceous values from particles containing oil shale in the fragmented mass; and collecting the released carbonaceous values at the bottom of the fragmented mass.

16. The method of claim 15, additionally comprising the step of forming a raise that extends from the room in the remaining portion of formation with its axis substantially parallel to the principal formation cleavage plane system, the surface of unfragmented formation adjacent the raise providing at least one free face extending approximately vertically in the volume to become the in situ retort, the detonating step comprising detonating explosive in blasting holes around the raise for expanding formation towards the raise.

17. A method of forming, in a subterranean formation containing oil shale, an in situ oil shale retort having side walls of unfragmented formation aligned with substantially vertically inclined subterranean formation cleavage planes, and containing fragmented oil shale, which comprises the steps of:

excavating at least one void in the subterranean formation with sides of such a void being substantially parallel to the substantially vertical formation cleavage planes and leaving a remaining portion of unfragmented formation within the side walls of the in situ retort being formed;

placing explosive in the formation adjacent said side walls in a position for preferentially fracturing said formation along the substantially vertical formation cleavage planes and expanding said remaining formation toward such a void; and detonating explosive for fracturing at least a portion of the formation along said substantially vertical formation cleavage planes and expanding said remaining formation toward such a void for fragmenting said remaining formation.

18. A method of forming an in situ oil shale retort in a subterranean formation containing oil shale, comprising the steps of:

excavating in the subterranean formation a void having boundaries approximately parallel to substantially vertical formation cleavage planes extending through the retort site, and leaving a remaining portion of unfragmented formation within the boundaries of the in situ retort being formed; and explosively expanding such remaining portion of unfragmented formation toward such a void to form a fragmented permeable mass of formation particles containing oil shale within the retort site.

19. The method as recited in claim 18 including explosively expanding such remaining formation to form such a fragmented mass within boundaries of unfragmented formation approximately parallel to such vertical formation cleavage planes.

20. The method as recited in claim 18 in which such formation has first and second orthogonal vertical cleavage plane sets; and including explosively expanding such remaining formation to form such a fragmented mass within approximately orthogonal side walls of unfragmented formation extending approximately parallel to the first and second vertical cleavage plane sets.

* * * * *